US011874074B2

(12) United States Patent
Horton et al.

(10) Patent No.: US 11,874,074 B2
(45) Date of Patent: Jan. 16, 2024

(54) SHAPE MORPHING FINS FOR FROST REMOVAL

(71) Applicant: Purdue Research Foundation, West Lafayette, IN (US)

(72) Inventors: William Travis Horton, West Lafayette, IN (US); Andres Arrieta Diaz, West Lafayette, IN (US); James Edward Braun, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

(21) Appl. No.: 17/855,965

(22) Filed: Jul. 1, 2022

(65) Prior Publication Data

US 2023/0015420 A1 Jan. 19, 2023

Related U.S. Application Data

(60) Provisional application No. 63/217,578, filed on Jul. 1, 2021.

(51) Int. Cl.

| | |
|---|---|
| ***F28F 17/00*** | (2006.01) |
| *F28F 19/00* | (2006.01) |
| *F28F 3/02* | (2006.01) |

(52) U.S. Cl.

CPC ..... *F28F 17/00* (2013.01); *F28F 3/02* (2013.01); *F28F 19/006* (2013.01); *F28F 2215/08* (2013.01); *F28F 2215/14* (2013.01)

(58) Field of Classification Search

CPC ..... F28F 17/00; F28F 2215/08; A44B 11/14; A44B 11/16

See application file for complete search history.

(56) References Cited

U.S. PATENT DOCUMENTS

| | | | | | |
|---|---|---|---|---|---|
| 1,348,795 | A * | 8/1920 | Giraudias | A44B 11/16 | 24/532 |
| 1,892,516 | A * | 12/1932 | Mosgrove | A44B 11/02 | 24/186 |
| 2,002,947 | A * | 5/1935 | Jacobs | A41F 11/12 | 24/200 |
| 2,015,863 | A * | 10/1935 | Mosgrove | A44B 11/04 | 24/186 |

(Continued)

FOREIGN PATENT DOCUMENTS

| | | | |
|---|---|---|---|
| CH | 235631 | A * | 6/1943 |
| FR | 739118 | A * | 6/1932 |

(Continued)

*Primary Examiner* — Devon Russell

(74) *Attorney, Agent, or Firm* — Purdue Research Foundation

(57) ABSTRACT

A shape-morphing fin includes a fixed portion, a multistable portion, a coupling portion, and a vibration source. The multistable portion functions as a negative stiffness element. The multistable portion is selectively movable between a first position and a second position. The movement between first position and the second position is configured to remove the ice formation from the structure. The coupling portion couples the fixed portion to the multistable portion. The vibration source is configured to produce a resonant vibration to engage the movement of the multistable portion from the first position to the second position.

19 Claims, 14 Drawing Sheets

(56) References Cited

U.S. PATENT DOCUMENTS

| | | | | | |
|---|---|---|---|---|---|
| 2,064,447 | A * | 12/1936 | Reutter | A44B 11/02 | 24/200 |
| 2,551,165 | A * | 5/1951 | Rochat | A44B 11/00 | 24/163 R |
| 2011/0197605 | A1* | 8/2011 | Suzuki | F28F 17/00 | 62/227 |
| 2020/0408473 | A1* | 12/2020 | Frechette | F28F 3/02 | |

FOREIGN PATENT DOCUMENTS

| | | | | | |
|---|---|---|---|---|---|
| GB | 484957 | A * | 9/1937 | | |
| GB | 2252875 | A * | 8/1992 | A47J 27/21108 | |
| GB | 2349508 | A * | 11/2000 | H01H 37/54 | |
| WO | WO-2018123984 | A1 * | 7/2018 | B23K 1/00 | |

* cited by examiner

SHAPE MORPHING FINS FOR FROST REMOVAL

CROSS REFERENCE TO RELATED APPLICATIONS

This application claims the benefit of U.S. Provisional Application Ser. No. 63/217,578, filed on Jul. 1, 2021. The entire disclosure of the above application is hereby incorporated herein by reference.

FIELD

The present disclosure relates to frost removal and, more particularly, to mechanical frost removal systems.

INTRODUCTION

This section provides background information related to the present disclosure which is not necessarily prior art.

Frost formation on heat exchanger fins is an undesirable circumstance. Frost degrades the performance of air-source heat pumps by restricting the airflow and increasing the thermal resistance of the heat exchanger. Conventional defrosting strategies for evaporators typically employ thermal approaches. Hot-gas bypass, reverse-cycle defrosting, and embedded electric resistance heaters are the leading thermal approaches to defrosting. Conventional thermal approaches have deficiencies in the form of high energy consumption, occupant discomfort, and a low rate of defrosting.

More recently, it has been studied that ultrasonic high-frequency vibrations are more effective in defrosting than low-frequency vibrations. These vibrations can be either excited using a laboratory shaker or embedded piezoelectric actuators. However, ultrasonic vibrations have several limitations. First, ultrasonic vibrations require specialized actuators, based on piezoelectric materials that can be expensive and may rapidly fatigue. Secondly, ultrasonic vibrations induce out-of-plane vibrations on the order of a few micrometers, which are not sufficiently large to break ice crystals. Thirdly, ultrasonic vibrations diffuse and damp out rapidly away from the actuation source. This restricts the de-icing effect to the region immediately adjacent to the actuators. Furthermore, ultrasonic vibrations require relatively high power, as power is quadratically related to the frequency.

Accordingly, there is a continuing need for a frost removal system that effectively removes frost formations more efficiently than known systems, such as thermal and ultrasonic approaches.

SUMMARY

In concordance with the instant disclosure, an energy efficient frost removal system with enhanced frost removal performance has been surprisingly discovered.

The shape-morphing fin is configured to remove an ice formation from a structure. The shape-morphing fin includes a fixed portion, a multistable portion, and a coupling portion. The multistable portion may be selectively movable between in a first position and a second position. The movement between first position and the second position may be configured to remove the ice formation from the structure. The coupling portion may couple the fixed portion to the multistable portion.

In another embodiment, the present technology may include methods of manufacturing the shape-morphing fin. For instance, a first method for manufacturing the shape-morphing fin may include providing a fixed portion, a multistable portion, a coupling portion, and a vibration source. The coupling portion may couple the fixed portion to the multistable portion. The multistable portion may be selectively movable between a first position and a second position. The movement of the multistable portion between the first position and the second position may be configured to remove the ice formations from the structure. Next, the method may include a step of forming an angle in the fixed portion. The vibration source may also be coupled to the fixed portion, the multistable portion, and/or the coupling portion.

In another embodiment, the present technology may include methods of using the shape-morphing fin. For instance, a second method for using the shape-morphing fin may include providing a fixed portion, a multistable portion, a coupling portion, and a vibration source. The coupling portion may couple the fixed portion to the metastable portion. The vibration source may be coupled to the fixed portion, the multistable portion, and/or the coupling portion. The multistable portion may be selectively movable between a first position and a second position. The movement of the multistable portion between the first position and the second position may be configured to remove the ice formations from the structure. Next, the second method may include a step of vibrating the multistable portion through the use of vibration source, thereby engaging the movement of the multistable position. Afterwards, the ice formation may be removed from the structure.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

DETAILED DESCRIPTION

Figure 1:
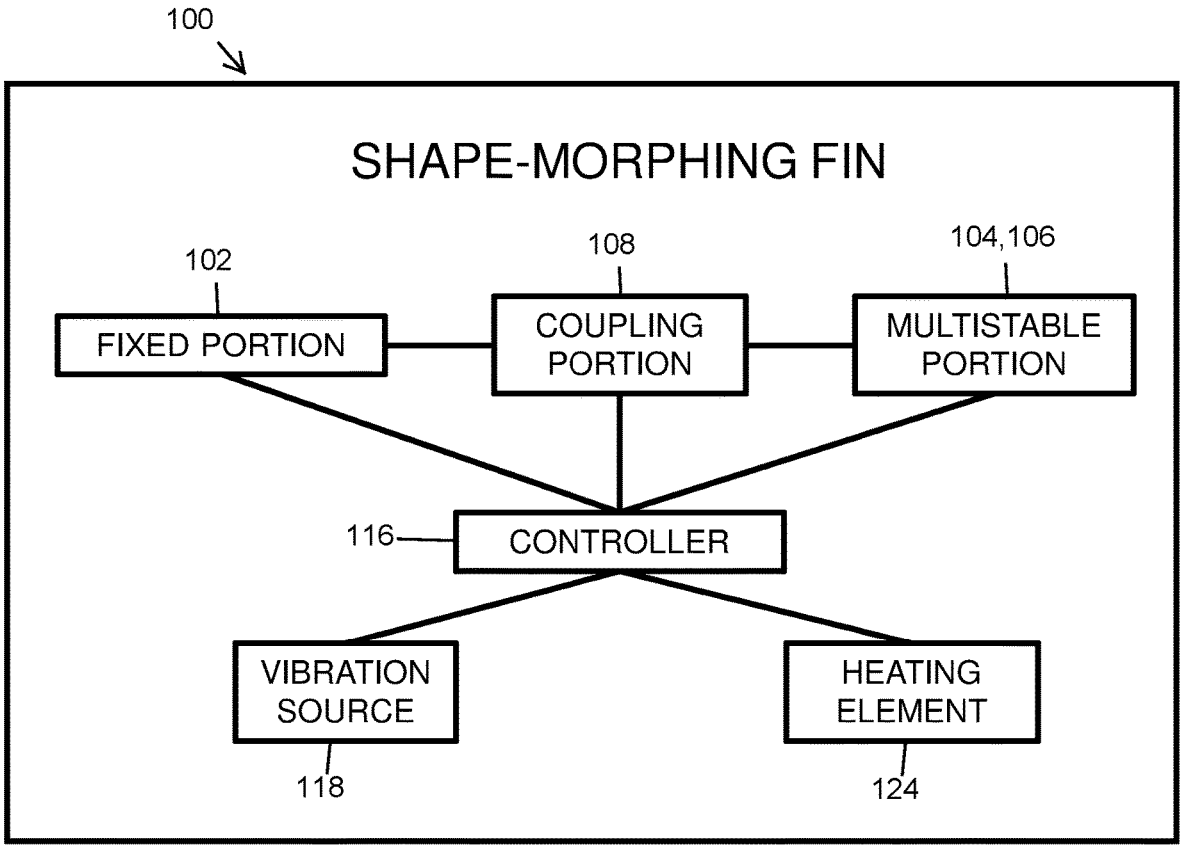
FIG. 1 is a box diagram of a shape-morphing fin including a fixed portion, a coupling portion, a multistable portion, a controller, a vibration source, and a heating element, according to one embodiment of the present disclosure.
Figure 2:
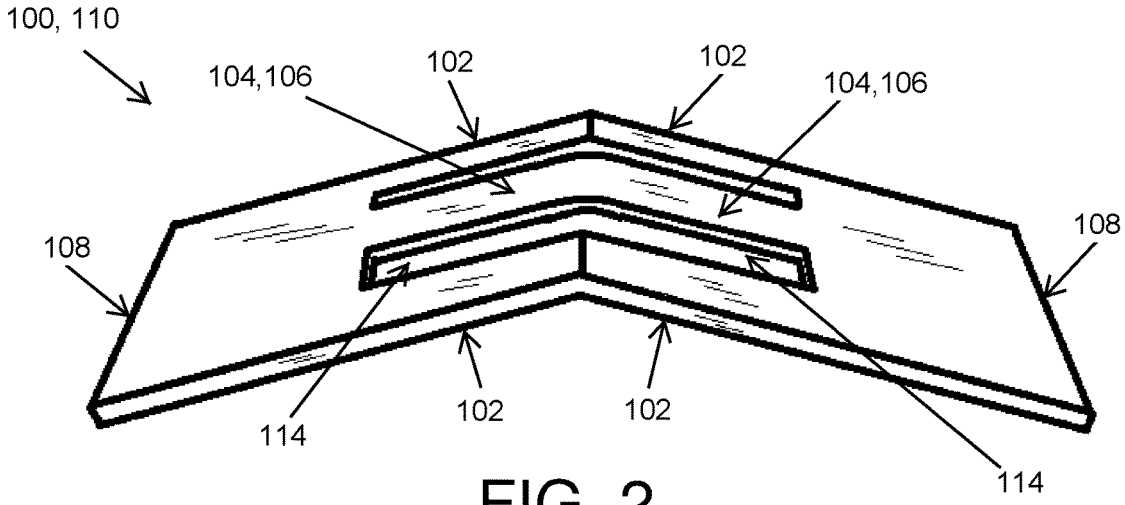
FIG. 2 is a top perspective view of a shape-morphing fin having a multistable portion disposed in a first position, according to one embodiment of the present disclosure.
Figure 3:
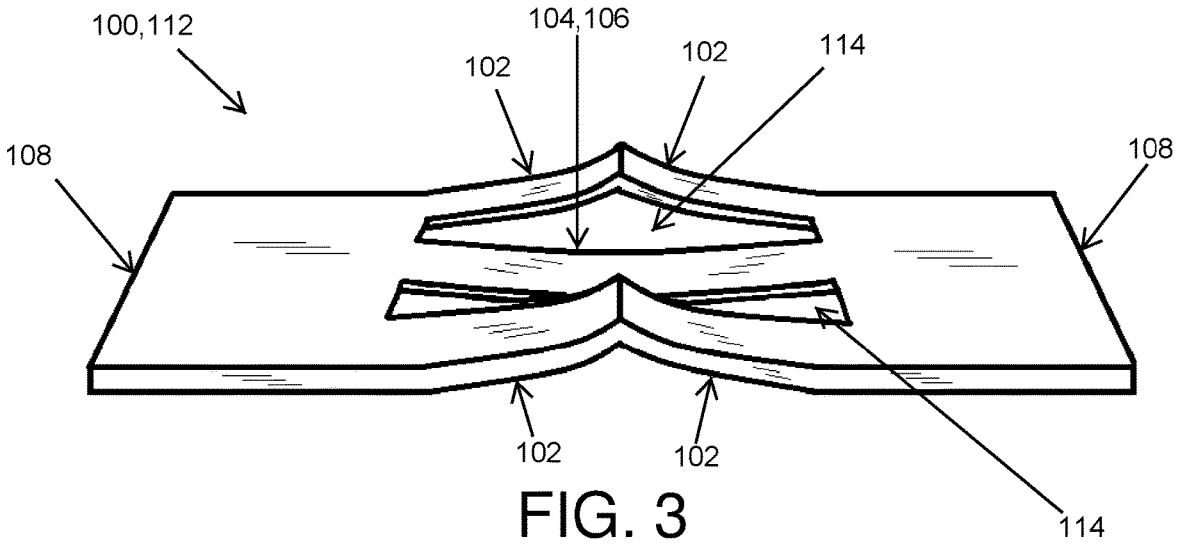
FIG. 3 is a top perspective view of the shape-morphing fin having the multistable portion disposed in a second position, according to one embodiment of the present disclosure.

The following description of technology is merely exemplary in nature of the subject matter, manufacture, and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature unless otherwise disclosed, and thus, the order of the steps can be different in various embodiments, including where certain steps can be simultaneously performed.

I. Definitions

Unless otherwise defined, all technical terms used herein have the same meaning as commonly understood by one of ordinary skill in the art to which the present disclosure pertains.

As used herein, the terms "a" and "an" indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters. In the present disclosure the terms "about" and "around" may allow for a degree of variability in a value or range, for example, within 10%, within 5%, or within 1% of a stated value or of a stated limit of a range. Likewise, in the present disclosure the term "substantially" can allow for a degree of variability in a value or range, for example, within 90%, within 95%, or within 99% of a stated value or of a stated limit of a range.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9,1-8,1-3,1-2,2-10, 2-8,2-3,3-10,3-9, and so on.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below," or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

II. Description

Figure 7:
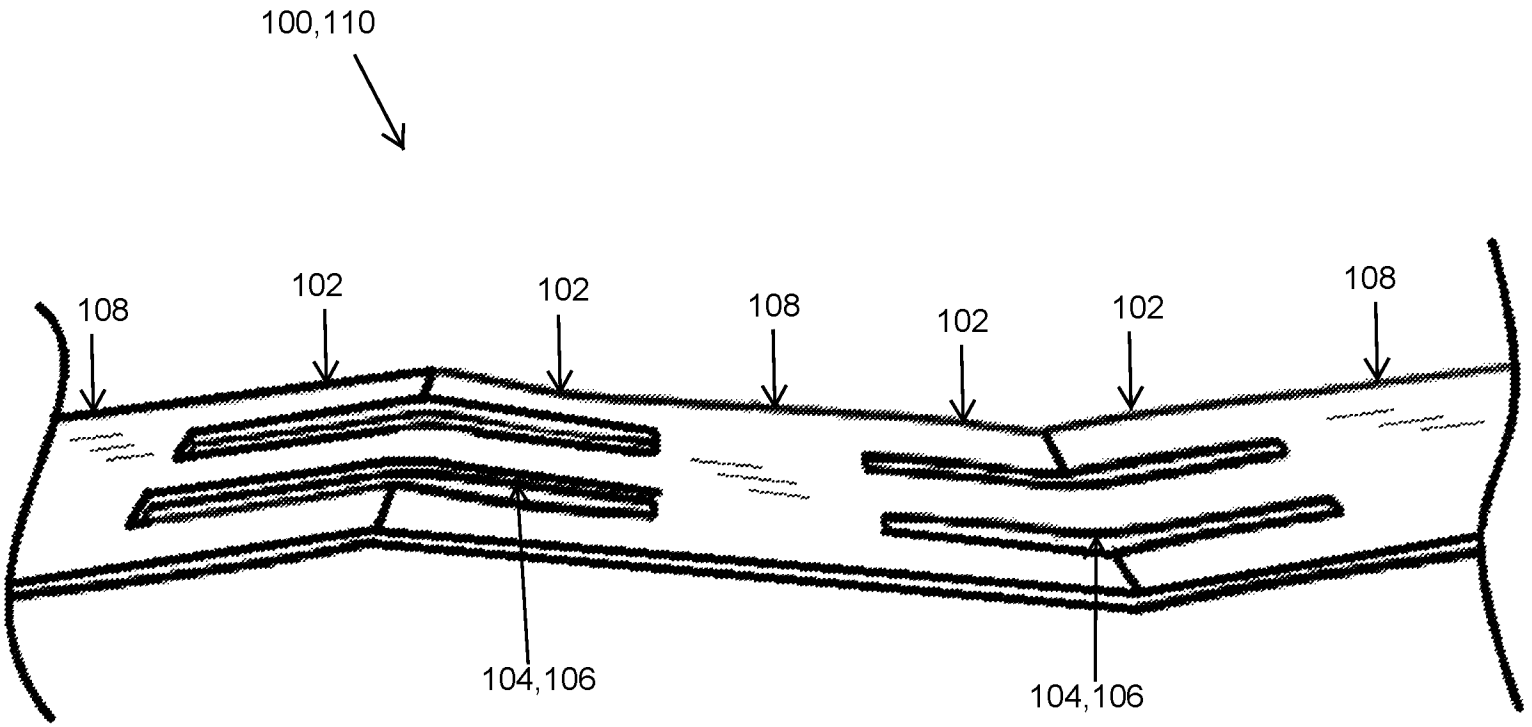
FIG. 7 is a top perspective view of the shape-morphing fin having a multistable portion disposed in a first position, further depicting plurality of shape-morphing fins coupled together, according to one embodiment of the present disclosure.
Figure 8:
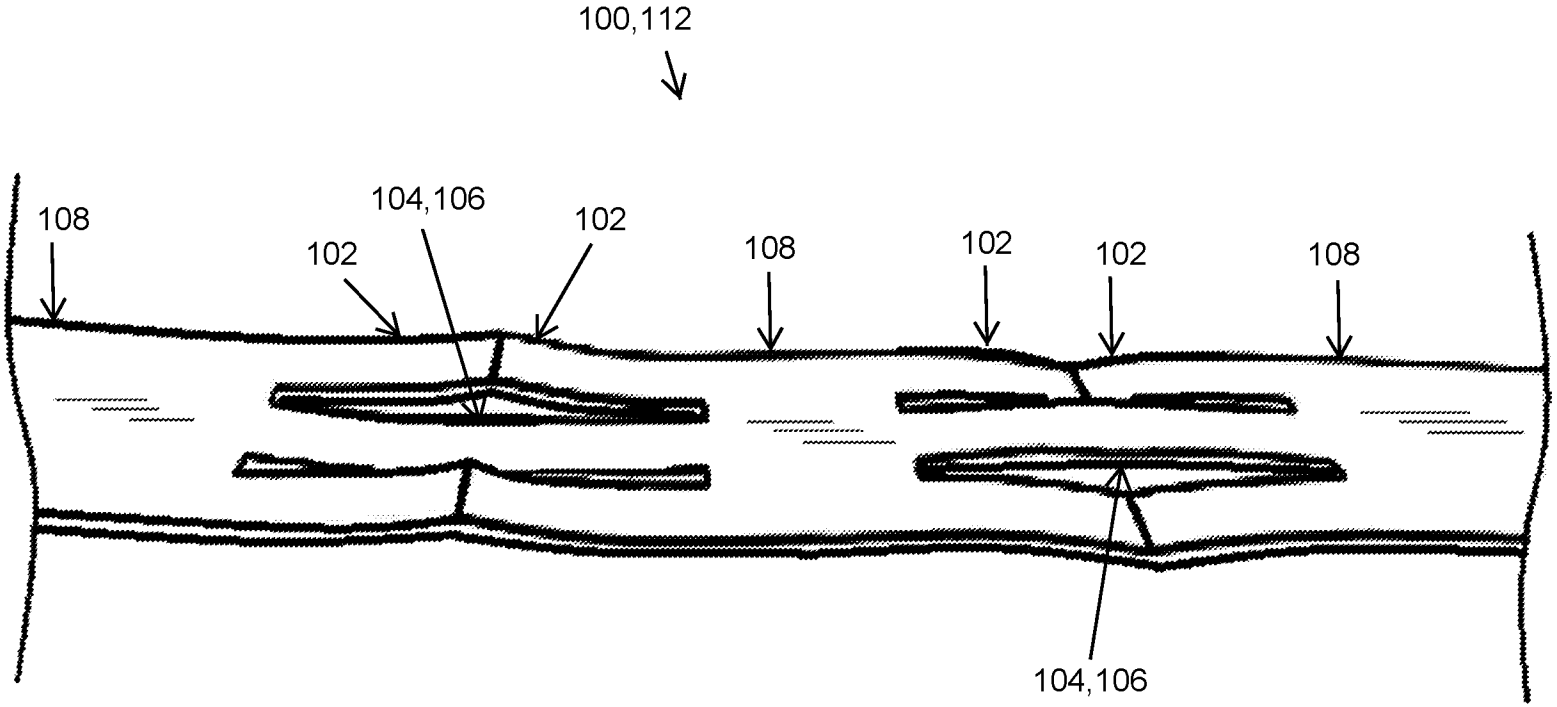
FIG. 8 is top perspective view of the shape-morphing fin, as shown in FIG. 7, having the multistable portion disposed in a second position, further depicting plurality of shape-morphing fins coupled together, according to one embodiment of the present disclosure.
Figure 9:
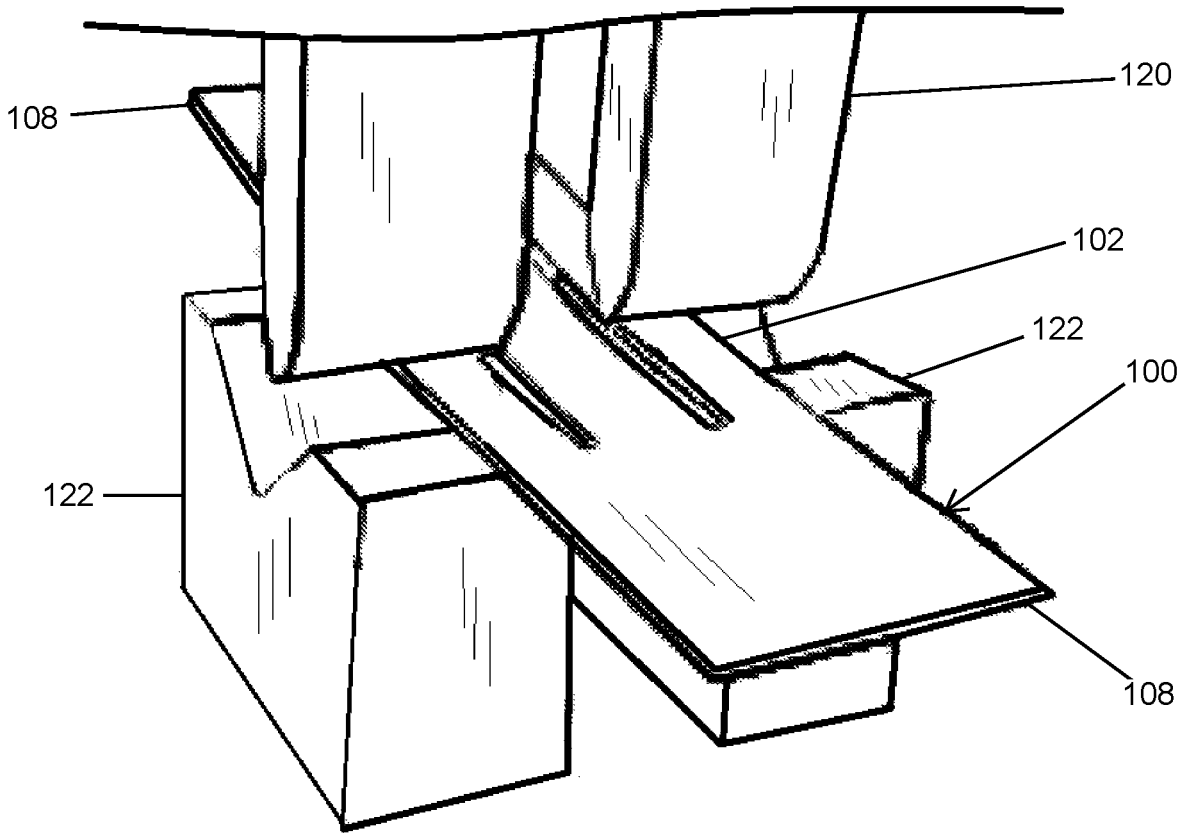
FIG. 9 is a top perspective view of a punch forming an angle in the fixed portion via plastic deformation, according to one embodiment of the present disclosure.
Figure 10:
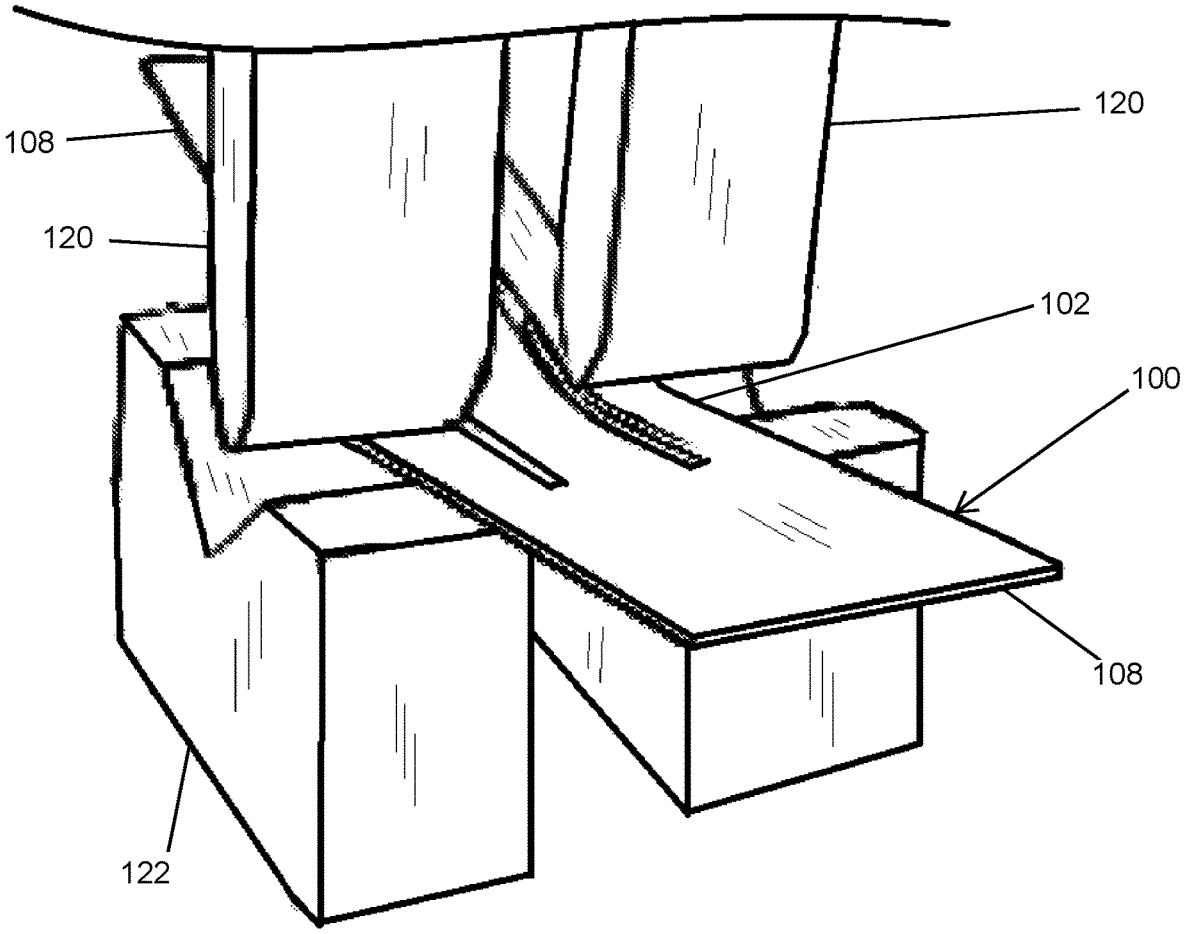
FIG. 10 is a top perspective view of the punch, as shown in FIG. 10, bending an angle in the fixed portion via plastic deformation.
Figure 11:
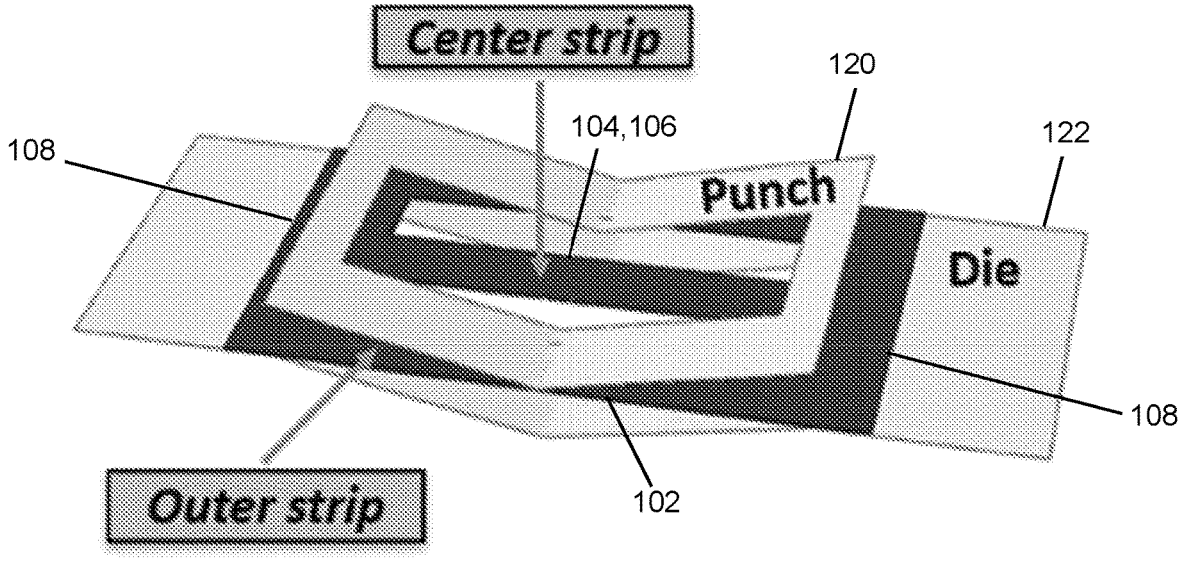
FIG. 11 is a top perspective view of a punch forming an angle in the fixed portion, further depicting a manufacturing process for a bistable structure, according to one embodiment of the present disclosure.
Figure 12:
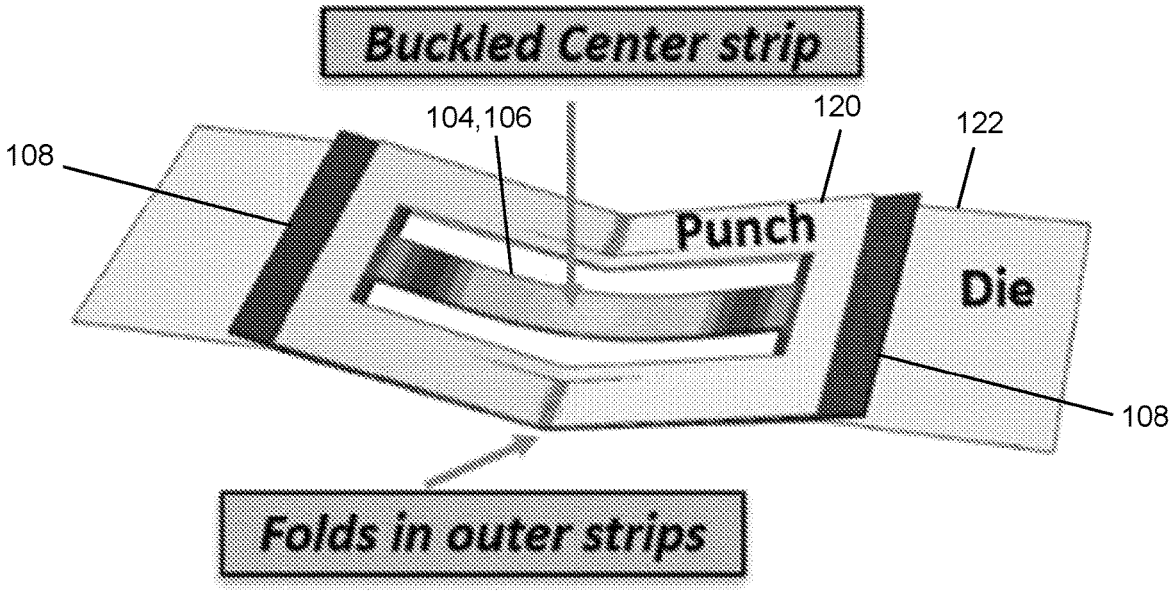
FIG. 12 is a top perspective view of a punch forming an angle in the fixed portion, thereby buckling the multistable portion, further depicting a manufacturing process for a metastable structure, according to one embodiment of the present disclosure.

The shape-morphing fin 100 is configured to remove an ice formation from a structure. In certain circumstances, the present disclosure may include the generation of a strain and/or the generation of resonant vibrations to engage a negative stiffness element for mechanical defrosting. As shown in FIGS. 1-6, the shape-morphing fin 100 includes a fixed portion 102, a multistable portion 104, 106, and a coupling portion 108. The multistable portion 104, 106 may function as the negative stiffness element. For instance, the multistable portion 104, 106 may be selectively movable between in a first position 110 and a second position 112. The movement between first position 110 and the second position 112 may be configured to remove the ice formation from the structure. The coupling portion 108 may couple the fixed portion 102 to the multistable portion 104, 106. In a specific, non-limiting example, the shape-morphing fin 100 may include a plurality of shape-morphing fins 100 coupled together by the coupling portion 108 in a chain formation, as shown in FIGS. 7-8.

Figure 4:
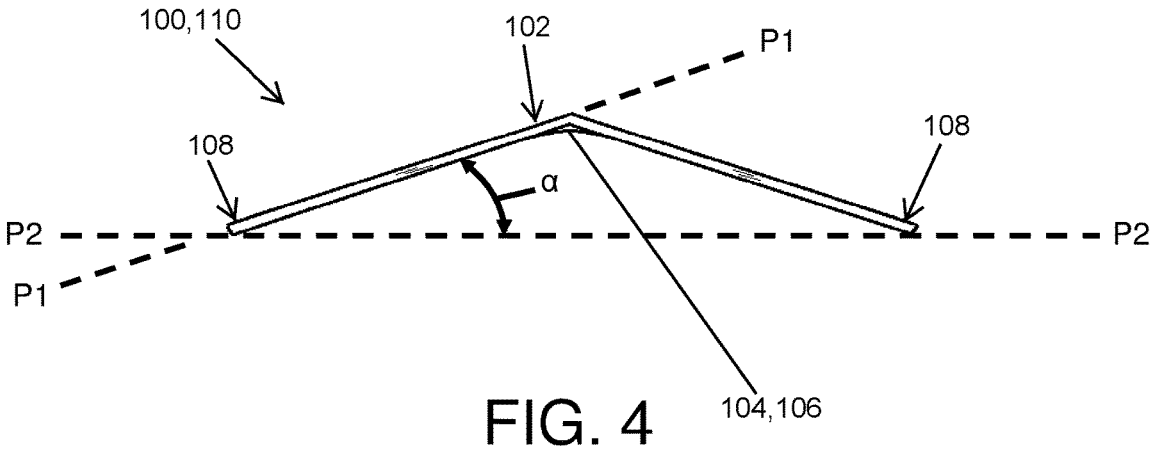
FIG. 4 is a front elevational view of the shape-morphing fin having the multistable portion disposed in a first position, further depicting an angle formed by bending the fixed portion and the multistable portion disposed substantially in line with the fixed portion, according to one embodiment of the present disclosure.
Figure 5:
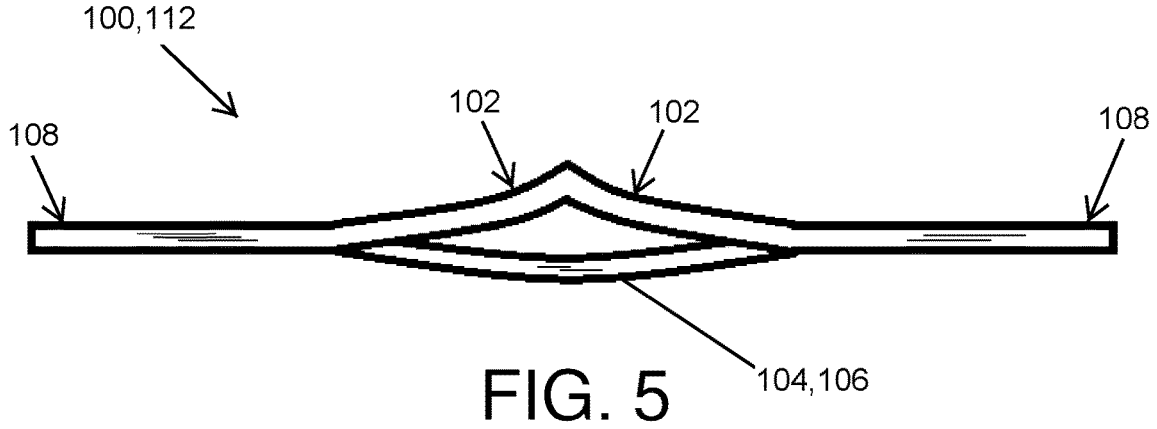
FIG. 5 is a front elevational view of the shape-morphing fin having the multistable portion disposed in a second position, further depicting the multistable portion disposed substantially out-of-line with the fixed portion, according to one embodiment of the present disclosure.
Figure 6:
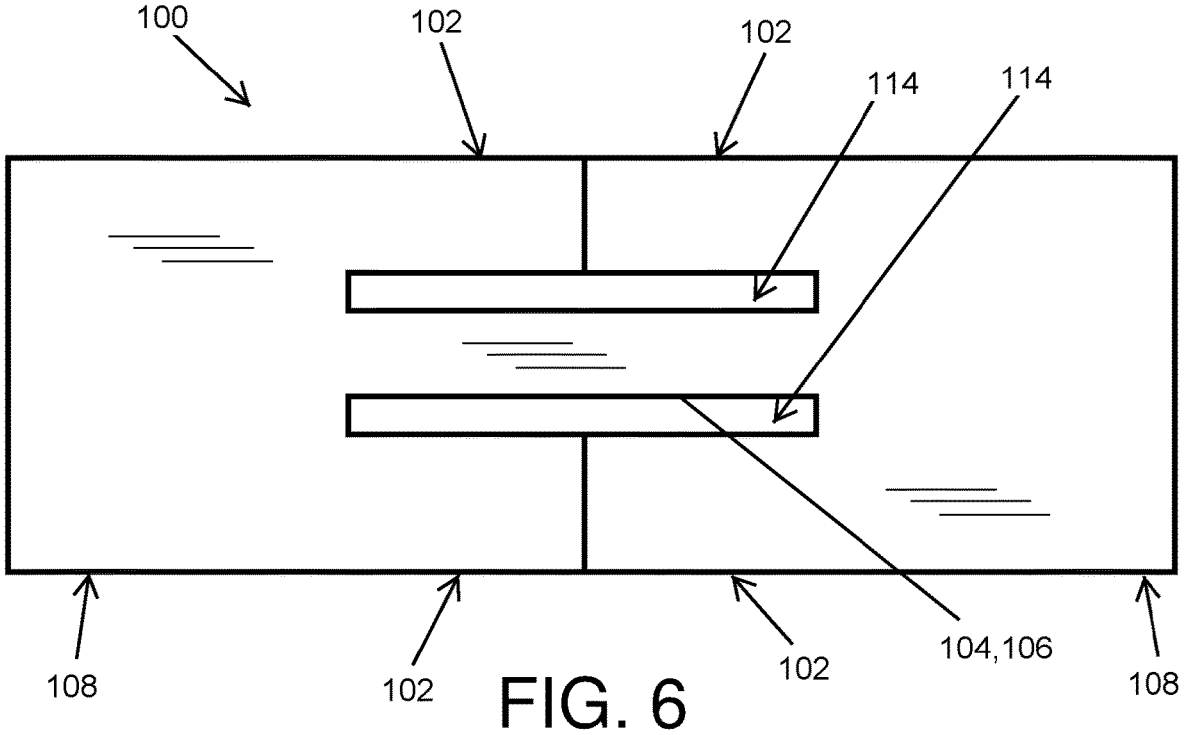
FIG. 6 is a top plan view of the shape-morphing fin, further depicting the fixed portion provided as outer strips divided by the multistable portion, according to one embodiment of the present disclosure.

The shape-morphing fin 100 may be provided in various ways. For instance, an aperture 114 may be disposed between the fixed portion 102 and the multistable portion 104, 106. The aperture 114 may enable to the multistable portion 104, 106 move at least partially independent from the fixed portion 102. In a specific example, as shown in FIGS. 1-3, and 6, the fixed portion 102 may be provided as a pair of outer strips divided by the multistable portion 104, 106. As shown in FIG. 4, the multistable portion 104, 106 in the first position 110 may be disposed substantially in-line with the fixed portion 102. Alternatively, as shown in FIG. 5, the multistable portion 104, 106 in the second position 112 may be disposed substantially out-of-line with the fixed portion 102. In another specific example, as shown in FIG. 4, an angle $\alpha$ may be formed between a first plane P1 of the fixed portion 102 in the first position 110 and a second plane P2 by bending the fixed portion 102. For instance, the angle $\alpha$ may be between around ten degrees to around eighty degrees. In a more specific example, the angle $\alpha$ may be between around twenty degrees to around forty-five degrees. In a specific example, the second plane P2 may be disposed at terminal ends of the shape-morphing fin 100. By bending the fixed portion 102, the angle $\alpha$ in may functionally provide a quasistatic loading feature. The angle $\alpha$ may result in the multistable portion 104, 106 to experience an increased strain. Advantageously, the increased strain may provide strain energy to the multistable portion 104, 106 for moving between the first position 110 and the second position 112.

Figure 15:
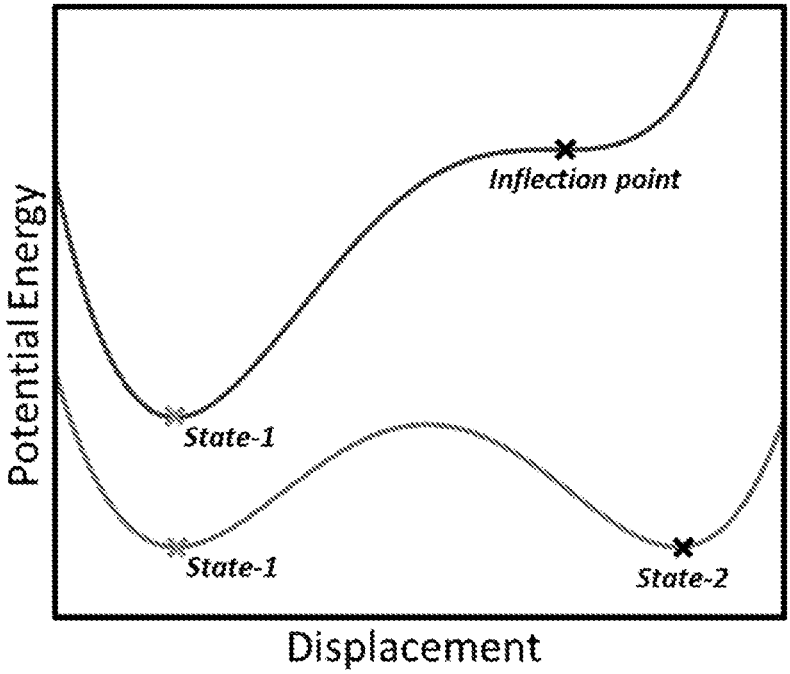
FIG. 15 is a line graph illustrating potential energy curves for bistable and metastable structures, according to one embodiment of the present disclosure.
Figure 16:
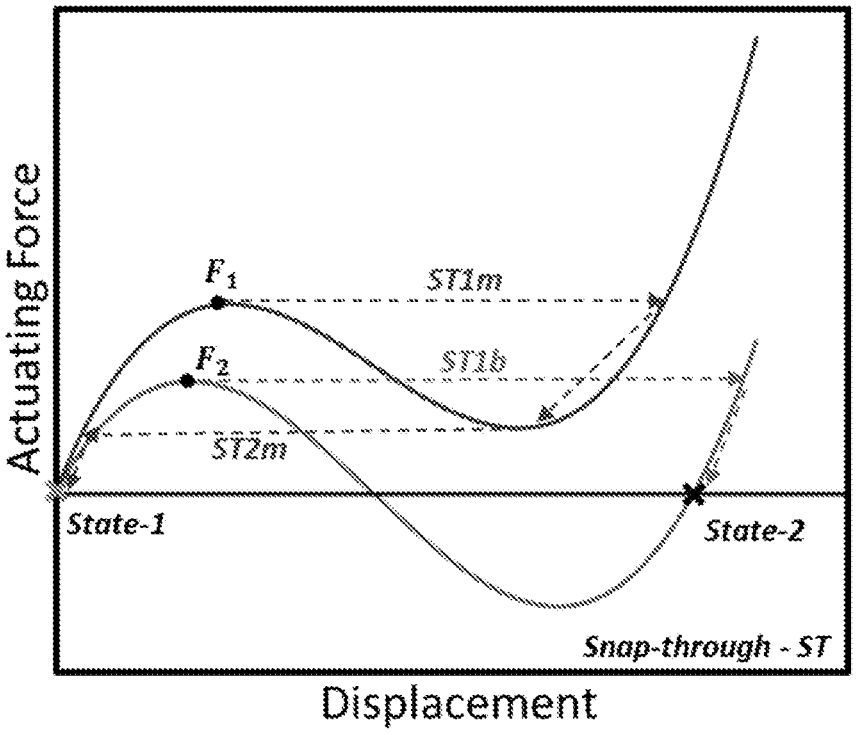
FIG. 16 is another line graph illustrating force-displacement curves for bistable and metastable structures, according to one embodiment of the present disclosure.

In certain circumstances, the multistable portion 104, 106 may have more than one state of equilibrium. For instance, as non-limiting example, the multistable portion 104, 106 may be a bistable structure 104 and/or a metastable structure 106. The bistable structure 104 may have two statically stable states that originate from storing strain energy in the system. The strain energy of bistable structure 104 may be described by a double-well energy curve, as shown in FIG. 15. The local minima correspond to two stable equilibrium points. The local maxima between the two stable equilibrium points may be an unstable equilibrium point. If no external perturbation is applied, the structure may be disposed at one of the two equilibrium points or the stable states. The local maxima of the potential energy curve may be visualized as the barrier between the two stable states. The multistable portion 104, 106 may transition between the stable states upon the imposition of an external perturbation. During the transition between states, bistable structures 104 may exhibit a negative stiffness behavior that pushes the structure into one of the two available stable states via a snap-through instability. There may be a sudden release of strain energy when the multistable portion 104, 106 transitions from one stable state to the other via the snap-through dynamic instability function. Advantageously, this snapthrough dynamic instability function may be reversible, and hence may be repeatable. Furthermore, given the small strains involved, these multistable portion 104, 106 structures may snap-through any number of times without losing their inherent multistability. In operation, the shape-morphing fin 100 may utilize large strains and high amplitude vibrations to engage the snap-through action to fracture and shed the ice formation, such as solid glaze-like ice layers. Metastable structures 106 also display a negative stiffness region, but they may have a stable state and a pseudo stable state. The energy curve of a metastable structure 106 may have a local minimum and an inflection point, as also shown in FIG. 15. The metastable structure 106 may undergo large deformation and subsequent snapthrough, providing energy release and vibrations for defrosting, similar to bistable structures 104. However, metastability implies that the metastable structure 106 will return to its single stable state upon releasing the load. In other words, the metastable structure 106 may undergo two snap-through instabilities for one actuating stroke. Thus, for similar energy barriers, the metastable structure 106 may be more energy-efficient than a bistable structure 104, as it would not require resetting. As shown in FIG. 16, the force-displacement curves of the same bistable structures 104 and metastable structures 106 have three distinct regions. The first region is the positive stiffness region until the peak force. The second region is the negative stiffness region, where any small perturbation applied beyond the peak force will cause the structure to snap-through. The third region is the positive stiffness region beyond the second stable state. For actuation beyond the peak load, the bistable structure 104 will settle in the second stable state after undergoing snap-through (ST1b). The metastable structure 106 will undergo the first snap-through (ST1 m) for actuating load greater than the peak load. The metastable structure 106 on the path to returning to the stable state exhibits negative stiffness and hence undergoes another snap-through (ST2 m). This second snap-through releases an additional amount of potential energy and further aids ice shedding. Thereafter, the structure settles to the original stable state.

In certain circumstances, the shape-morphing fin 100 may include various ways to actuate the movement of the multistable portion 104, 106. For instance, the shape-morphing fin 100 may include a controller 116 communicatively coupled to at least one of the fixed portion 102, the multistable portion 104, 106, and the coupling portion 108. The controller 116 may be configured to selectively actuate the multistable portion 104, 106 between the first position 110 and the second position 112. In a specific example, the controller 116 may include a processor and a memory. The memory may include non-transitory processor-executable instructions directing the controller 116 to actuate the multistable portion 104, 106 between the first position 110 and the second position 112 at a predetermined time and/or in a predetermined sequence. The shape-morphing fin 100 may also include a vibration source 118 coupled to the controller 116. The vibration source 118 may be configured to produce a vibrational frequency. The controller 116 may selectively actuate the multistable portion 104, 106 through the use of the vibrational frequency. More particularly, the controller 116 may selectively control when the vibrational frequency may engage the multistable portion 104, 106 to transition between the first position 110 and the second position 112. In a specific example, the vibrational frequency may be between one-tenth hertz to one-thousand hertz. In another specific example, the vibrational frequency may functionally provide a dynamic loading feature to create adhesive and cohesive fractures at an ice-fin interface. The mixed-mode fracture may help to delaminate and shed the ice layer. The mechanism of defrosting may involve exciting the resonant vibrations of a frost branch and/or a frost base layer of the ice formation. Specifically, resonant vibrations generate tensile and shear stresses that may lead to a mixed-mode fracture and shedding of the frost layer.

The shape-morphing fin 100 may be manufactured from various materials and processes. In a specific example, the fixed portion 102 and the multistable portion 104, 106 may be constructed from the same material. In another specific example, the fixed portion 102 and/or the multistable portion 104, 106 may be constructed from a metallic material. In an even more specific example, the fixed portion 102 and/or the multistable portion 104, 106 may be constructed from weld steel and/or copper-coated aluminum. Advantageously, where the fixed portion 102 and/or the multistable portion 104, 106 are constructed from a metallic material, the shape-morphing fin 100 may provide an opportunity to add the defrosting functionality to heat exchangers without affecting heat exchanger performance. For instance, the shape-morphing fin 100 may be advantageously provided as a component in a heat pump.

In certain circumstances, the shape-morphing fin 100 may also be more economically manufactured due to an uncomplicated and efficient manufacturing process. As a non-limiting example, the embedded negative stiffness leading to the snap-through behavior may be achieved by introducing plastic deformation in the fixed portion 102 outer strips of the shape-morphing fin 100. High residual stresses due to plastic deformation bends may store strain energy into the multistable portion 104, 106 resulting in bistability or metastability, depending on the chosen design. The energy released from the snap-through action when jumping between the two stable shapes may be directly proportional to the magnitude of the induced residual stresses. This snap-through may lead to large strains and ensuing vibrations, which may subsequently fracture and shed the frost layer from the shape-morphing fin 100. The amount of ice fractured and shed, along with the rate of ice shedding may be dependent on the potential energy released during the snap-through. The snap-through in the bistable structure 104 or metastable structure 106 may initiate when the actuating force on the structure reaches the peak force. The bistable structure 104 or metastable structure 106 may exhibit negative stiffness behavior due to any loading beyond the peak force and undergo snap-through. The potential energy released due to the bistable structure 104 or metastable structure 106 snapping may be converted to vibrations. The compressive and shear strains in the ice formation during the snap-through may predominantly dictate the cohesive and adhesive fracturing of the ice formation. The ensuing ice shedding may be a function of the post snap-through vibrations. The dominant frequency of the vibrations may be around the resonance of the second stable state in the bistable structure 104 and may be around the resonance of the pseudo stable state in the metastable structure 106.

The combination of plastic deformation induced in the fixed portion 106 outer strips and the geometry of the shape-morphing fin 100 may allow for controlling the bistability or metastability of the multistable portion 104, 106. Specifically, residual stresses in the shape-morphing fin 100 are critical in determining whether the morphing fin will exhibit bistability, metastability, or mono stability. Advantageously, the plastic deformation in the fixed portion 106 outer strips and the induced residual stresses may be adaptable to exhibit bistability, metastability, or mono stability.

The plastic deformation and subsequent buckling of the multistable portion 104, 106 may produce various shapes. For instance, the actuation of the multistable portion 104, 106 may give rise to concave and/or convex shapes. The shape-morphing fin 100 may have curved and/or angled geometry and/or low out-of-plane stiffness. This may lead to a highly nonlinear response and/or high amplitude oscillations for both quasistatic and dynamic loading. The large strains and/or high amplitude oscillations may fracture and shed the frost layer. Advantageously, the defrosting performance of the mechanical approach in the present disclosure may be orders of magnitude more energetically efficient than the known purely thermal approaches for frost removal.

Figure 21:
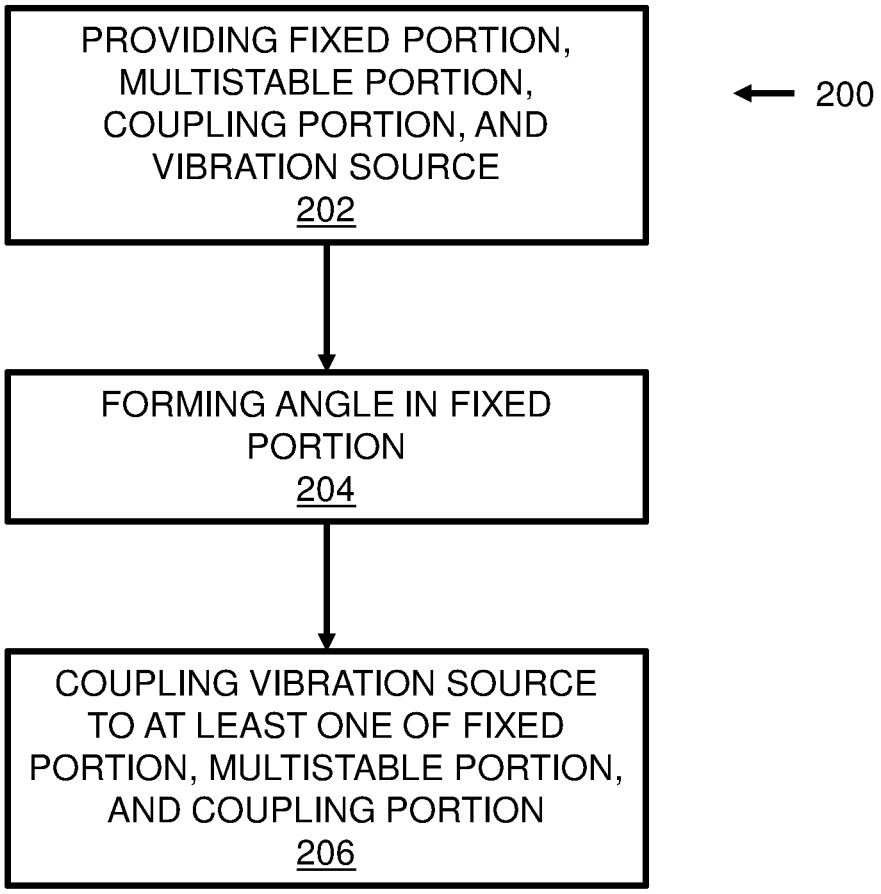
FIG. 21 is a flow chart illustrating a method of manufacturing the shape-morphing fin, according to one embodiment of the present disclosure.

In another embodiment, the present technology may include methods of manufacturing the shape-morphing fin 100. For instance, as shown in FIG. 21, a first method 200 for manufacturing the shape-morphing fin 100 may include providing a fixed portion 102, a multistable portion 104, 106, a coupling portion 108, and a vibration source 118. The coupling portion 108 may couple the fixed portion 102 to the multistable portion 104, 106. The vibration source 118 may also be coupled to the fixed portion 102, the multistable portion 104, 106, and/or the coupling portion 108. The multistable portion 104, 106 may be selectively movable between a first position 110 and a second position 112. The movement of the multistable portion 104, 106 between the first position 110 and the second position 112 may be configured to remove the ice formations from the structure. Next, the method 200 may include a step 204 of forming an angle $\alpha$ in the fixed portion 102. In a specific example, the angle $\alpha$ may be formed in the fixed portion 102 by utilizing a press 120, 122. In an even more specific embodiment, the press 120, 122 may introduce plastic deformation in the outer strips of the shape-morphing fin 100. Provided as a specific, non-limiting example, the geometry selection of the shape-morphing fin 100 and the plastic deformation bend may be designed with the guidance of finite element (FE) analysis. The press 120, 122 may include a hydraulic press. In an even more specific example, the press 120, 122 may include a punch 120 and a die 122 to introduce the plastic deformation in the fixed portion 102, as shown in FIGS. 9-12. It should be appreciated that the punch 120 may travel an entirety of the distance between the punch 120 and the die 122. The variation in the angle $\alpha$ of bend may be achieved by selecting a deeper die angle, such as 90°, than the required angle $\alpha$ of bend in the fixed portion 102, such as less than 60°. It should also be appreciated that the first method 200 may be used to manufacture shape-morphing fins 100 of different thicknesses as well as either the bistable structure 104 or the metastable structure 106.

Figure 22:
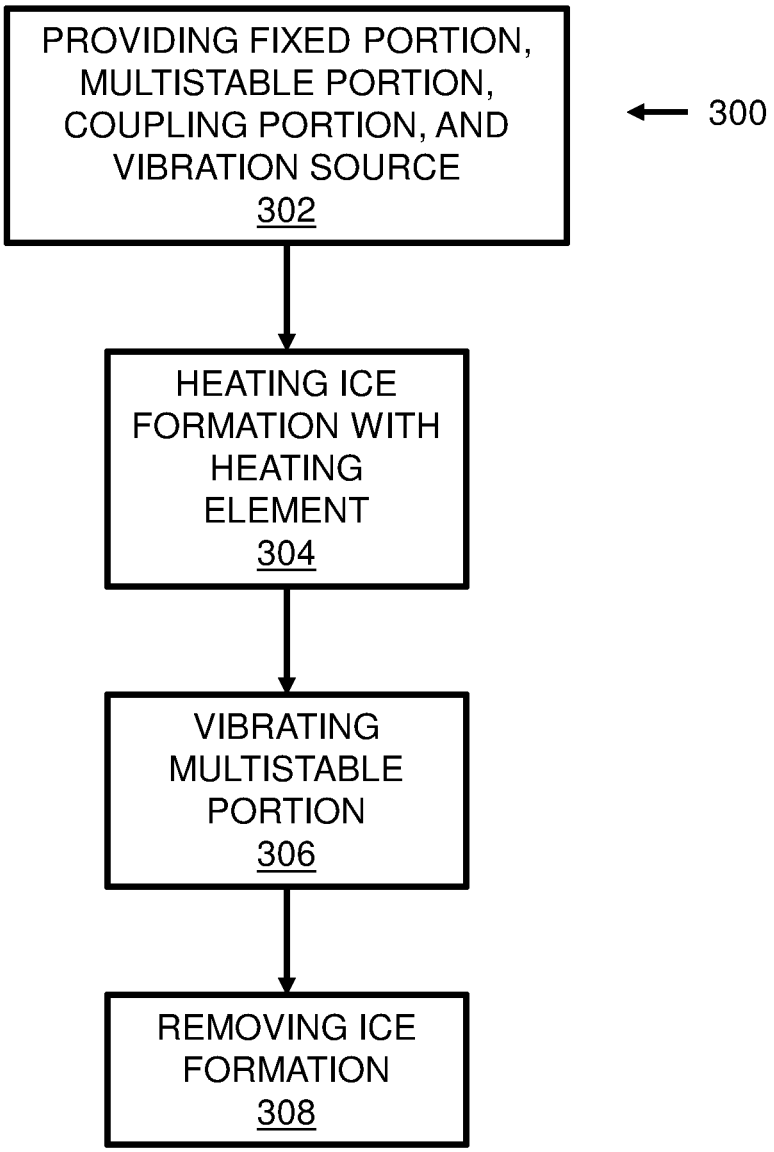
FIG. 22 is a flow chart illustrating a method of using the shape-morphing fin, according to one embodiment of the present disclosure.

In another embodiment, the present technology may include methods of using the shape-morphing fin 100. For instance, as shown in FIG. 22, a second method 300 for using the shape-morphing fin 100 may include providing a fixed portion 102, a multistable portion 104, 106, a coupling portion 108, a controller 116, and a vibration source 118. In a specific example, the shape-morphing fin 100 may also include a heating element 124. The heating element 124 may be coupled to the fixed portion 102, the multistable portion 104, 106, the coupling portion 108, and/or the controller. The coupling portion 108 may couple the fixed portion 102 to the multistable portion 104, 106. The vibration source 118 may be coupled to the fixed portion 102, the multistable portion 104, 106, and/or the coupling portion 108. The multistable portion 104, 106 may be selectively movable between a first position 110 and a second position 112. The movement of the multistable portion 104, 106 between the first position 110 and the second position 112 may be configured to remove the ice formations from the structure. In a specific example, the second method 300 may optionally include heating the ice formation through the use of the heating element 124. Without being bound to any particular theory, it is believed initially heating the ice formation may increase the density of the ice formation, which may further enhance the frost removal performance of the shape-morphing fin 100. In a specific example, the heating element 124 may also be actuated by the controller 116. In a more specific example, the heating element 124 may be autonomously actuated by the controller 116. It should be appreciated that the energy requirements for utilizing the heating element 124 with the shape-morphing fin 100 may still be significantly lower than known purely thermal approaches for frost removal. Next, the second method 300 may include a step 306 of vibrating the multistable portion 104, 106 through the use of vibration source 118, thereby engaging the movement of the multistable position between the first position 110 and the second position 112. Afterwards, the ice formation may be removed from the structure.

III. Example

The following experimental setups, components, characteristics, and results are provided as a specific, non-limiting examples.

Figure 17:
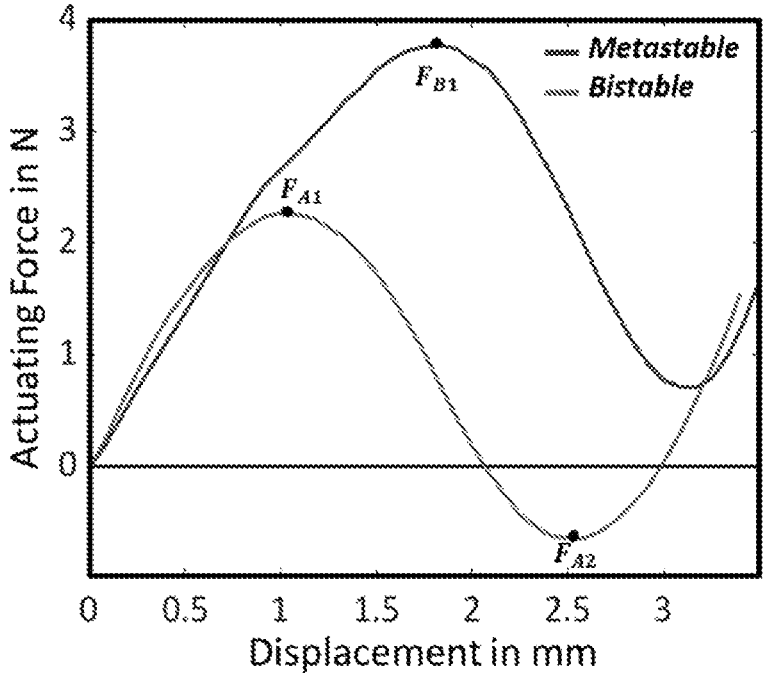
FIG. 17 is a line graph illustrating experimental force-displacement plots for a set of shape-morphing fins made out of copper-coated aluminum with bistable structures and metastable structures, according to one embodiment of the present disclosure.
Figure 18:
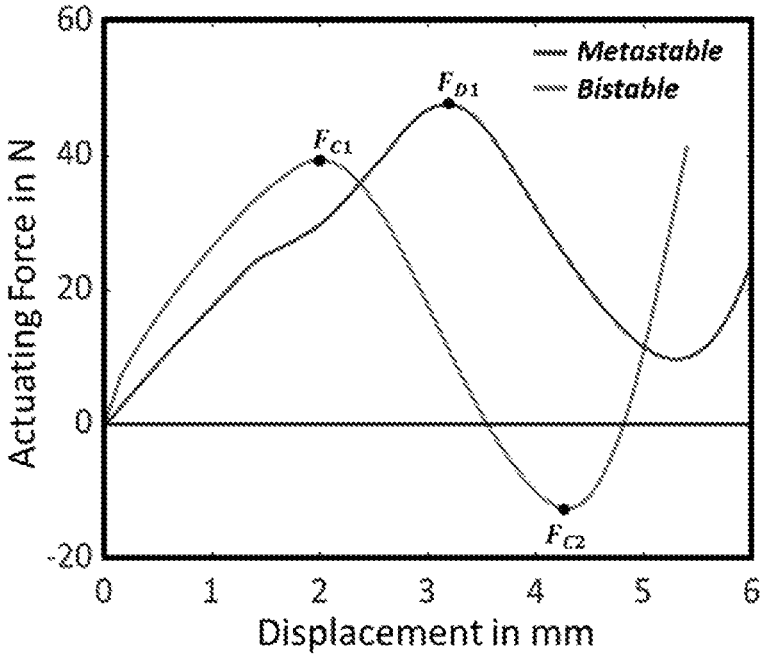
FIG. 18 is a line graph illustrating experimental force-displacement plots for a set of shape-morphing fins made out of weld-steel with bistable structures and metastable structures, according to one embodiment of the present disclosure.

To investigate certain stability characteristics of the shape-morphing fin 100, compressive tests on a manufactured shape-morphing fins 100 were conducted. One set of metastable structures 106 and one set of bistable structures 104 were manufactured out of a copper-coated aluminum alloy having a thickness around 0.48 mm, and another set out of weld steel having a thickness of around 0.79 mm. Both sets of morphing fins have identical base geometry in the flat configuration. The metastable structure 106 and bistable structure 104 behavior of the sets of morphing fins 100 were adjusted to different bend angles and hence varying levels of plastic deformation. The experimentally obtained force-displacement plots for a set of bistable 104 (specimen A) and metastable 106 (specimen B) fins manufactured from the copper-coated aluminum are shown in FIG. 17. The experimentally obtained force-displacement plots for another set of bistable 104 (specimen C) and metastable 106 (specimen D) fins manufactured from the weld steel are shown in FIG. 18. The peak forces for the weld steel specimens are an order of magnitude greater than the copper-coated aluminum specimens. Table 1, provided below, summarizes the peak forces and actuation energy required for the four specimens. The metastable 106 samples provide two snap-throughs per actuation. The bistable 104 specimens, however, need to be actuated twice to gain two snap-throughs.

TABLE 1

Bistable Characteristic of Specimens

| Specimen | Material | Bistability | Peak Force N(lbf) | Actuation Energy mJ(mcal) |
|---|---|---|---|---|
| A | Copper-coated Aluminum | Bistable | $F_{A1}$ = 2.27(0.51)<br>$F_{A2}$ = −0.65(−0.15) | $E_{A1}$ = 0.86(0.20)<br>$E_{A2}$ = 0.16(0.03) |
| B | Copper-coated Aluminum | Metastable | $F_{B1}$ = 3.78(0.85) | $E_{B1}$ = 2.78(0.66) |
| C | Weld Steel | Bistable | $F_{C1}$ = 39.38<br>$F_{C2}$ = −12.63(−2.78) | $E_{C1}$ = 29.16(6.97)<br>$E_{C2}$ = 3.24(0.78) |
| D | Weld Steel | Metastable | $F_{D1}$ = 3.17(0.71) | $E_{D1}$ = 71.25(17.03) |

Figure 13:
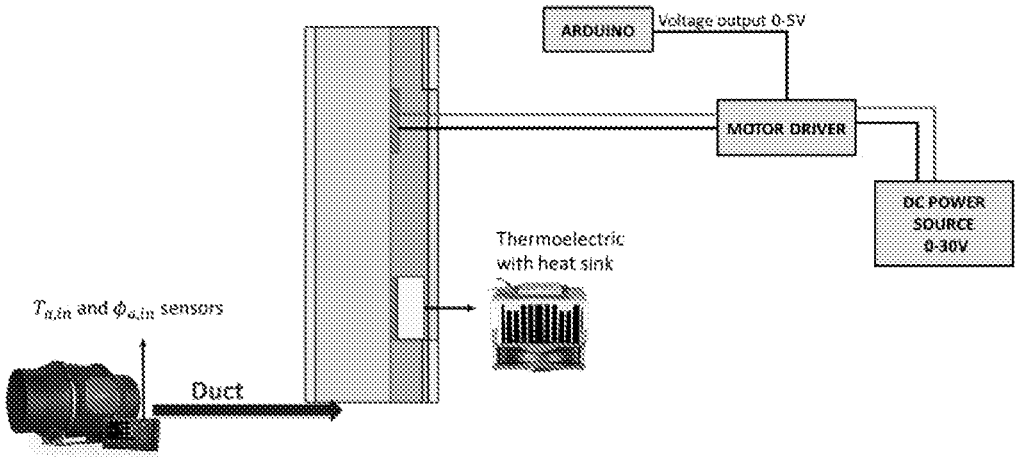
FIG. 13 is a schematic diagram of an experimental setup for testing frost formation on a shape-morphing fin, according to one embodiment of the present disclosure.
Figure 14:
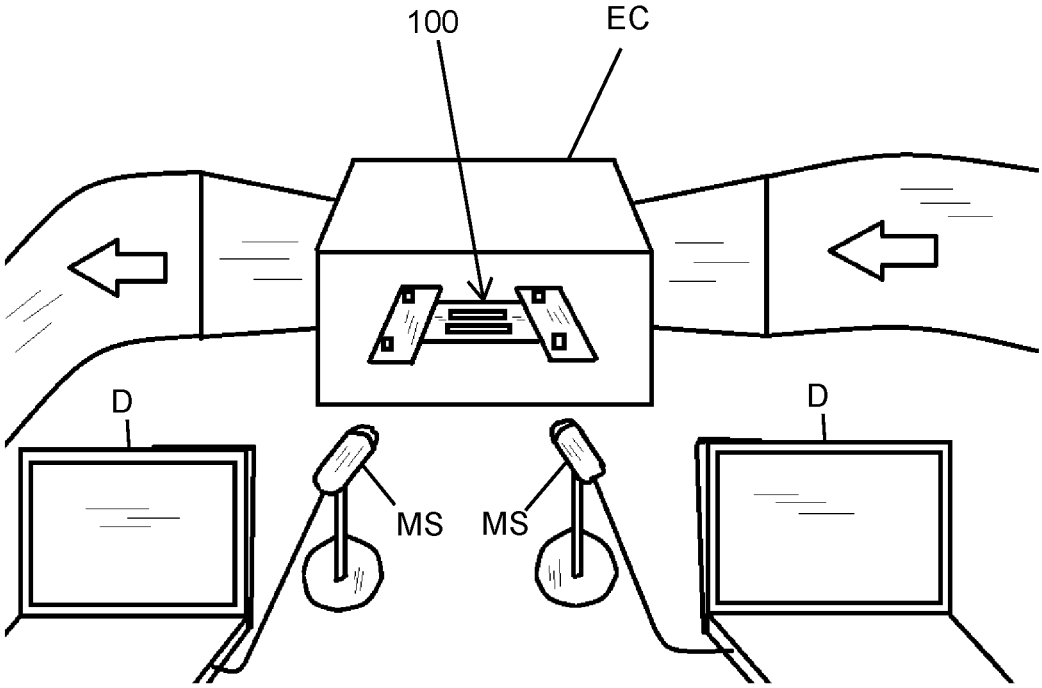
FIG. 14 is a schematic diagram of an experimental setup for testing frost formation on a shape-morphing fin, according to one embodiment of the present disclosure.

Frost formation occurs in five stages: 1) condensation, 2) frost nucleation growth, 3) frost crystal growth, 4) frost layer growth, and 5) frost layer fully grown. Frost growth characterization is a challenging problem in refrigeration science. There are often conflicting results found in the literature. This is because the type of frost formed on evaporator fins is different for each specific case of airflow, surface temperature, and fin profile. Although there are experimental studies in the literature that classify the type of ice formed, due to the unique nature of the frost formed for each condition, it is difficult to know the mechanical properties of frost beforehand. There is no standardized experimental procedure to test the mechanical properties of the frost; hence, it is necessary to build a test setup that allows an approach for examining mechanical defrosting in situ. The experimental setup, illustrated in FIGS. 13-14, is purposely designed to simulate heat pump operating conditions. The setup is portable and when placed in a psychrometric chamber, can test across a wide range of inlet conditions and can compare energy consumption with conventional defrosting methods. The experimental rig consists of an enclosing chamber EC made of acrylic sheets. This chamber has two channels, a cooling channel and a heating channel. Thermoelectric devices with embedded air-cooled heat sinks are used to create the temperature differential needed to achieve frost formation on the shape-morphing fin 100. The experimental rig may further include a microscope MS and a display D to monitor the frost formation of the fin 100. The experimental set up can form different types of frost depending on the inlet air conditions and the surface temperature. However, each type of frost will have different mechanical properties and will have a different response to the same excitation. In particular, these experimental results were focused on the deicing of solid glaze-like ice. This glaze-like ice is formed by saturating the morphing fin surface with water, and subsequently supercooling it using the thermoelectric devices. Imposing rotation of the heat sinks underneath the thermoelectric devices induces a moment on the edges of the shape-morphing fin 100. This moment actuation is used to snap-through the bistable structure 104 cyclically between two stable states. Applying a moment beyond peak loading results in the sudden release of the potential energy via the snap-through instability, and subsequently high amplitude post snap-through vibrations. The transverse shear and tensile stresses produced may be enough to first cohesively and then adhesively fracture the ice layer. The post buckled vibrations ultimately shed the ice. In a vertical arrangement, the fractured ice may be easier to shed, and hence more efficient.

Figure 19:
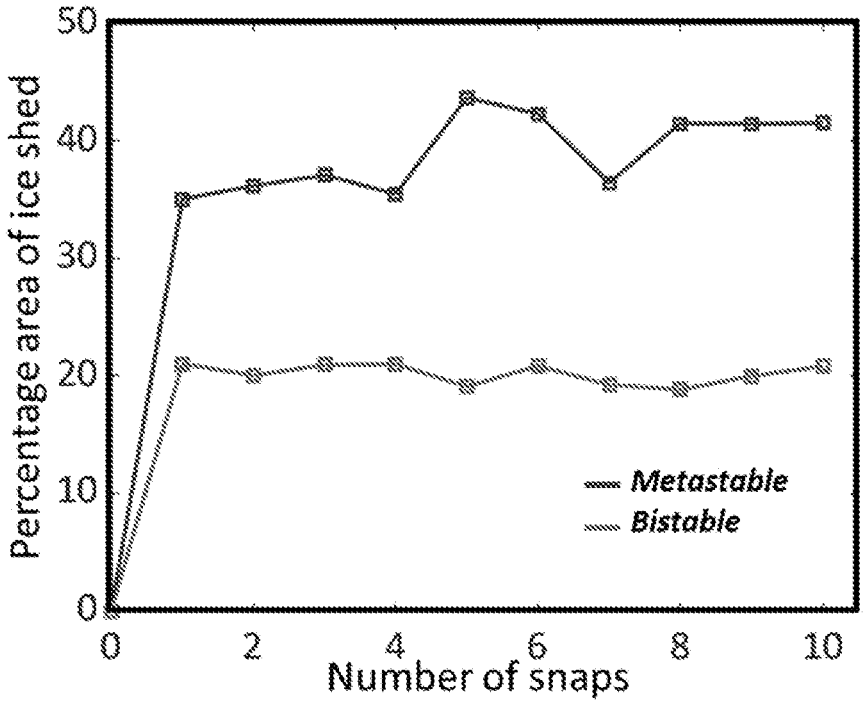
FIG. 19 is a line graph illustrating the number of snaps it required for copper coated aluminum shape-morphing fins to remove various percentages of ice formations, according to one embodiment of the present disclosure.
Figure 20:
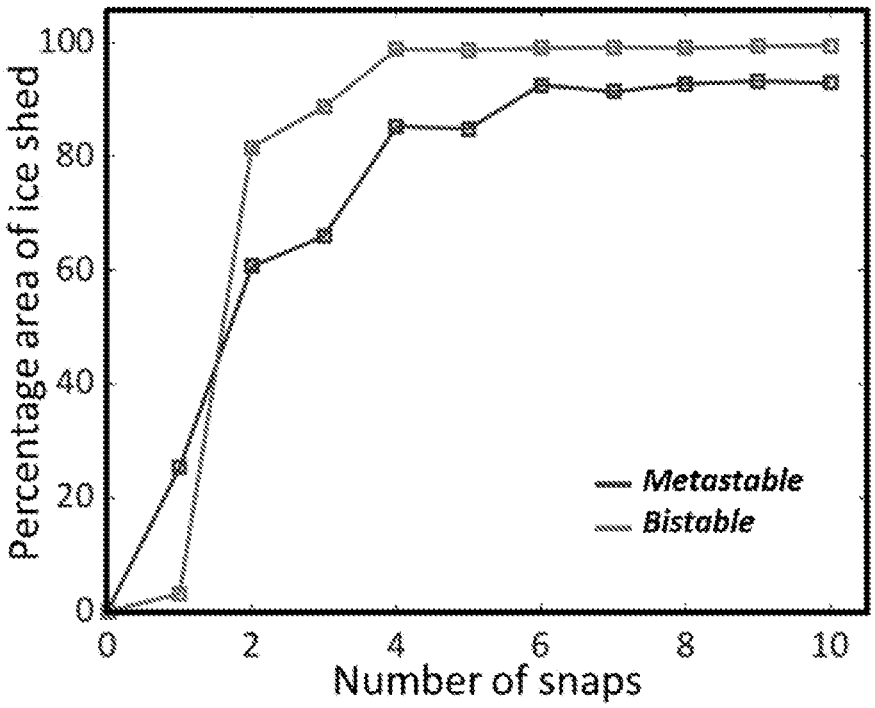
FIG. 20 is a line graph illustrating the number of snaps it required for weld-steel shape-morphing fins to remove various percentages of ice formations; according to one embodiment of the present disclosure.

Loading the shape-morphing fin 100 cyclically may lead to more ice shed from the shape-morphing fin 100. Image analysis was used to investigate the effect of the number of snap-throughs on the percentage area of the ice shed. A comparison of the percentage area of ice remaining on the surface of the shape morphing fin 100 vs the number of cycles for specimens A, B, C, and D are illustrated in FIGS. 19-20. It is observed that most of the ice shedding occurs in the first few cycles of the snap-through and reaches a plateau thereafter. This indicates that there is an optimal number of cycles for each morphing fin 100, for a given thickness of glaze-like ice. For copper-coated aluminum specimen B (metastable 106), a plateau of 43.67% area of the ice shed is reached after 5 snaps or 2 actuation strokes. Copper-coated aluminum specimen A (bistable 104) reaches a plateau of 21.03% area of the ice shed only after the first snap; there is almost no ice shed after the first actuation stroke. The weld steel specimen D (metastable 106) sheds 92.62% area of the ice after 6 snaps or 3 actuation strokes and the weld steel specimen C (bistable 104) sheds 98.83% area of the ice after 4 snaps or 4 actuation strokes. The percentage area of the ice shed does not necessarily monotonically increase, especially in the case of copper-coated aluminum fins. The large stresses and the snap-through sometimes push back the shed ice onto the fin from the surroundings. This leads to a decrease in the percentage area of the ice shed. The maximum area of the ice layer undergoing adhesive fracture is greater than the maximum percentage area of the ice shed. This is due to the horizontal configuration of the experimental setup; in a vertical experimental setup almost all the adhesively fractured ice will be shed immediately, and the optimal number of snaps will be fewer. Weld steel specimens outperform the copper-coated aluminum specimens significantly. This is believed to be due to two reasons; copper-coated aluminum is slightly hydrophilic compared to the weld steel fin which is hydrophobic, and the energy stored in the weld steel fin is almost ten times compared to the copper coated-aluminum fin. However, the material cost of the weld steel fin is higher as well as the evaporator performance will be lower due to the larger thickness. The trade-off between thickness and defrosting performance can be optimized to have a cost-effective and high performing mechanical defrosting strategy.

To test the energy savings potential of the shape-morphing fin 100 compared to known thermal defrosting approaches, the same setup described in FIGS. 13-14 was utilized. However, the polarity of the thermoelectric devices was reversed, thereby imposing the opposite temperature differential compared to when conducting the ice formation step. This polarity reversing simulates a conventional reverse cycle defrosting thermal approach, and hot gas bypass defrosting at a smaller scale. Hence, the experimental set up permits a direct comparison of the mechanical and thermal defrost approach. As a basis for comparing the input energy requirements, an optimal number of snaps for each fin was used. The optimal number of snaps for each fin may be understood to be the number of snaps needed to reach a plateau in ice shedding as summarized in Table 2, provided on the following page. The energy consumption for the known thermal defrost strategy was calculated by monitoring the power consumption from a DC power source. For a similar thickness of glaze-like ice formed on the weld steel morphing fins, the mechanical defrosting approach may be several orders of magnitude more energy efficient than the known thermal defrost strategy. For copper-coated aluminum fins, the mechanical defrosting is able to shed around 23.0% and around 43.67% of ice. When viewing the percentage of ice shed, the mechanical approach may be faster and may be more energy efficient than the known thermal defrost strategy.

TABLE 2

Energy Consumption for Mechanical and Thermal Mehods

| Specimen | Optimal Number of Snaps | Percentage Area of Ice Shed | Total Actuation Energy J (cal) | Thermal Energy to Melt Equivalent Ice J (cal) |
|---|---|---|---|---|
| A | 1 | 23.01 | $8.60\ (1.92) \times 10^{-4}$ | 1570 (375) |
| B | 5 | 43.67 | $5.56\ (1.33) \times 10^{-3}$ | 7069 (1690) |
| C | 4 | 98.83 | $6.48\ (1.55) \times 10^{-2}$ | 15802 (3777) |
| D | 6 | 92.62 | $1.43\ (0.34) \times 10^{1}$ | 11565 (2764) |

Advantageously, the shape-morphing fin 100 may provide an energy efficient frost removal system with enhanced frost removal performance. Desirably, costly thermodynamic cycle reversal and discomfort from a cold blow effect may be militated against by using shape adaptations for mechanical defrosting.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions, and methods can be made within the scope of the present technology, with substantially similar results.

What is claimed is:

1. A shape-morphing fin configured to remove an ice formation from a structure, wherein the shape-morphing fin comprises:

a fixed portion;

a multistable portion that is selectively movable between in a first position and a second position, wherein the movement between the first position and the second position is configured to remove the ice formation from the structure;

a coupling portion that couples the fixed portion to the multistable portion; and a controller communicatively coupled to at least one of the fixed portion, the multistable portion, and the coupling portion, and the controller is configured to selectively actuate the multistable portion between the first position and the second position.

2. The shape-morphing fin of claim 1, further comprising an aperture disposed between the fixed portion and the multistable portion.

3. The shape-morphing fin of claim 1, wherein the fixed portion includes a pair of outer strips divided by the multistable portion.

4. The shape-morphing fin of claim 1, wherein the fixed portion and the multistable portion are constructed from the same material.

5. The shape-morphing fin of claim 4, wherein the fixed portion and the multistable portion are constructed from a metallic material.

6. The shape-morphing fin of claim 1, wherein the multistable portion is disposed substantially in-line with the fixed portion in the first position.

7. The shape-morphing fin of claim 1, wherein the multistable portion is disposed substantially out-of-line with the fixed portion in the second position.

8. The shape-morphing fin of claim 1, wherein an angle is formed between a first plane of the fixed portion and a second plane by bending the fixed portion.

9. The shape-morphing fin of claim 8, wherein the angle is between around ten degrees to around sixty degrees.

10. The shape-morphing fin of claim 1, wherein the multistable portion is bistable.

11. The shape-morphing fin of claim 1, wherein the multistable portion is metastable.

12. A heat pump with the shape-morphing fin of claim 1.

13. The shape-morphing fin of claim 1, further comprising a vibration source coupled to the controller, the vibration source is configured to produce a vibrational frequency, and the controller selectively actuates the multistable portion through the use of the vibrational frequency.

14. The shape-morphing fin of claim 13, where the vibrational frequency is between one-tenth hertz to one-thousand hertz.

15. A method of manufacturing a shape-morphing fin configured to remove an ice formation from a structure, the method comprising the steps of:

providing a fixed portion, a multistable portion, a coupling portion, and a vibration source, the coupling portion couples the fixed portion to the multistable portion, the multistable portion is selectively movable between a first position and a second position, the movement between the first position and the second position is configured to remove the ice formation from the structure;

forming an angle in the fixed portion; and coupling the vibration source to at least one of the fixed portion, the multistable portion, and the coupling portion.

16. The method of claim 15, wherein the step of forming the angle in the fixed portion includes utilizing a press.

17. A method of using a shape-morphing fin configured to remove an ice formation from a structure, the method comprising the steps of:

providing a fixed portion, a multistable portion, a coupling portion, and a vibration source, the coupling portion couples the fixed portion to the multistable portion, the vibration source is coupled to at least one of the fixed portion, the multistable portion, and the coupling portion, the multistable portion is selectively movable between a first position and a second position, the movement between the first position and the second position is configured to remove the ice formation from the structure;

vibrating the multistable portion through the use of vibration source, thereby engaging the movement of the multistable portion;

removing the ice formation from the structure.

18. The method of claim 17, further comprising a step of providing a heating element after the step of providing the fixed portion, the multistable portion, the coupling portion, and the vibration source, but before the step of vibrating the multistable portion.

19. The method of claim 18, further comprising a step of heating the ice formation through the use of the heating element after the step of providing the heating element, but before the step of vibrating the multistable portion.

* * * * *